US005628103A

United States Patent [19]

Ayotte et al.

[11] Patent Number: 5,628,103

[45] Date of Patent: May 13, 1997

[54] METHOD FOR MOUNTING A SEAT ATTACHMENT

[75] Inventors: John Ayotte, Eagan; Peter W. A. Bergin, Hopkins, both of Minn.

[73] Assignee: MTS Northwest Sound, Inc., Minneapolis, Minn.

[21] Appl. No.: 698,230

[22] Filed: Aug. 14, 1996

Related U.S. Application Data

[60] Continuation of Ser. No. 370,725, Jan. 10, 1995, which is a division of Ser. No. 25,374, Feb. 26, 1993, Pat. No. 5,421, 638.

[51] Int. Cl.[6] ..... A47C 7/62

[52] U.S. Cl. ..... 29/525.01; 29/505; 29/514; 297/248; 248/312.1; 248/295.11; 224/555

[58] Field of Search ..... 29/505, 514, 525.01; 297/191, 188, 248, 232; 248/312, 312.1, 295.1; 224/42.45 R

[56] References Cited

U.S. PATENT DOCUMENTS

| | | | |
|---|---|---|---|
| D. 307,852 | 5/1990 | Clark | D7/620 |
| D. 328,223 | 7/1992 | Clark | D7/619 |
| 1,149,541 | 8/1915 | Rees | 297/191 |
| 1,149,549 | 8/1915 | Rees et al. | 297/191 |
| 1,680,469 | 8/1928 | Morgan | 248/295.1 |
| 2,132,331 | 10/1938 | Wanamaker | 155/1 |
| 2,319,109 | 5/1943 | Bulloch | 272/57 |
| 2,364,647 | 12/1944 | O'Connor | 155/194 |
| 2,471,030 | 5/1949 | Foulke | 211/75 |
| 2,706,516 | 4/1955 | Nordmark | 155/188 |
| 2,807,315 | 9/1957 | Manne | 155/188 |
| 3,041,107 | 6/1962 | Schaefer | 297/248 |
| 3,172,713 | 3/1965 | Rupert | 312/235 |
| 3,565,384 | 2/1971 | Lockwood | 248/312 |
| 4,865,237 | 9/1989 | Allen | 224/42.45 |
| 5,320,319 | 6/1994 | Winger et al. | 348/312.1 |

*Primary Examiner*—Larry I. Schwartz
*Assistant Examiner*—Marc W. Butler
*Attorney, Agent, or Firm*—Westman, Champlin & Kelly, P.A.

[57] ABSTRACT

A seat attachment capable of being mounting on the standard of a seat. The seat attachment comprises a container holder, a first flexible arm extending from the container holder and a second flexible arm extending from the container holder. A first mounting bracket is located at a first end of the first arm and a second mounting bracket is located at a first end of the second arm. The seat attachment is mounted on the seat through the use of a plurality of bolts, each of which is inserted through a hole in one of the mounting brackets, through a hole in the standard, and a into a corresponding hole in the seat. When the bolts are tightened, the first and second arms substantially conform to the shape of the seat on which they are mounted.

4 Claims, 4 Drawing Sheets

Fig. 5
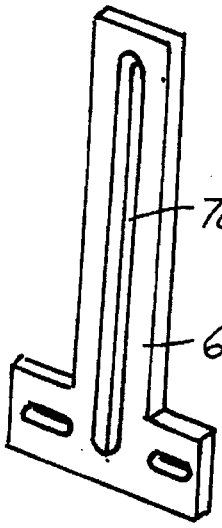
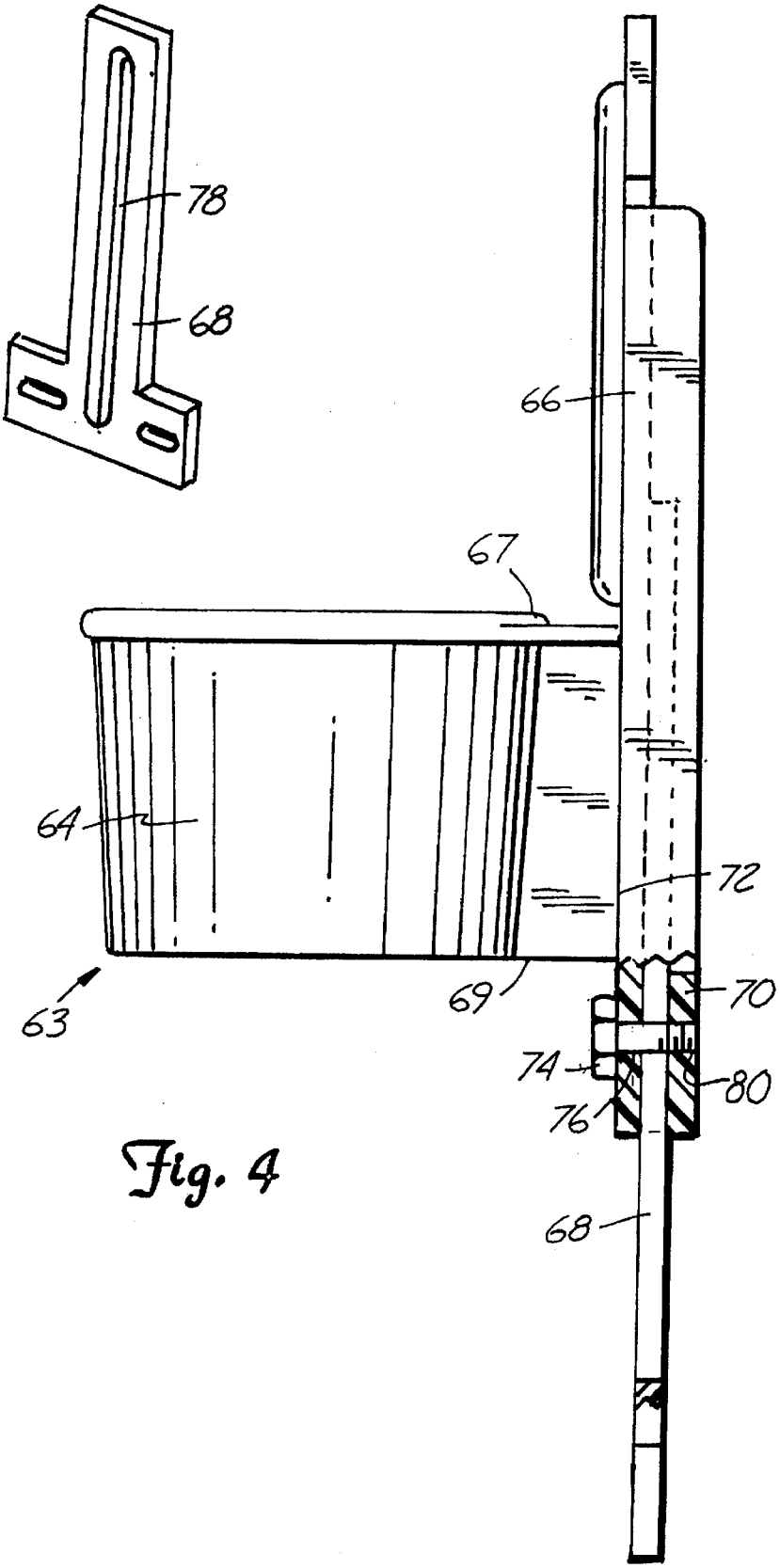
Fig. 4

METHOD FOR MOUNTING A SEAT ATTACHMENT

This is a file wrapper continuation of application Ser. No. 08/370,725, filed Jan. 10, 1995, which is a division of application Ser. No. 08/025,374, filed Feb. 26, 1993 now U.S. Pat. No. 5,421,038.

BACKGROUND OF THE INVENTION

The present invention relates to a seat attachment having a container holder which can be mounted on the standard of a seat and, in particular, to a seat attachment which can be mounted on the standard of a seat in a manner that prevents the container holder from protruding into the aisle behind the seat.

In stadiums, arenas and theaters, a common problem is the lack of a place to rest beverage or popcorn containers. Often, containers are placed on the floor or on the arm of the seat, only to be accidentally knocked over or otherwise spilled. In the alternative, the occupant of a seat must hold the containers, thereby restricting the use of his hands.

A number of types of container holders have been used to alleviate this problem. Among those are various container holders that are adapted to be mounted to the back of a seat. Container holders of this type often protrude into the aisle behind the seat. In addition, many such container holders are limited to being mounted on only one type of seat or standard and cannot be adapted to be mounted on other types of seats. Further, in mounting such container holders, bolts are used which must be provided and which require the drilling of additional holes in the seat back.

There is therefore a need for a container holder which can be mounted on a seat in a manner which substantially prevents it from protruding into the aisle behind the seat. It would be beneficial for the container holder to be able to be mounted without drilling any additional holes in the seat and without the use of any new hardware.

SUMMARY OF THE INVENTION

The present invention provides a seat attachment which can be mounted on the standard of a seat. The seat attachment comprises a container holder having a first end and a second end, a first flexible arm extending from the first end of the container holder, and a second flexible arm extending from the second end of the container holder. A first mounting bracket is located at an end of the first arm furthest from the container holder and a second mounting bracket is located at an end of the second arm furthest from the container holder.

The seat attachment is mounted on the seat through the use of the bolts used to attach the seat back to the standard. Each bolt extends through a mounting hole in one of the mounting brackets, through a hole in a portion of the standard, and into a corresponding hole in the seat. Upon tightening the bolts, the first arm and the second arm will bend or flex to generally conform to the shape of the seat on which the seat attachment is mounted. In addition, the first and second mounting brackets will bend or flex to conform to the portion of the standard to which they are attached.

The second arm can be designed such that it is adjustable in length. In such an arrangement, a sleeve is attached to one side of the container holder and the second arm is inserted therein. The distance that the second arm extends from the container holder can be varied by sliding the second arm in the sleeve, enabling the seat attachment to be used with a variety of standards. A tightening bolt extends through a hole in the sleeve, through a slot in the second arm, and into a second hole in the sleeve. The tightening bolt can be tightened to rigidly hold the second arm in the sleeve after the second arm is adjusted to a desired length.

BRIEF DESCRIPTION OF THE DRAWINGS

FIG. 4 is a side view of a modified form of the seat attachment of the present invention; and FIG. 5 is a perspective view of a portion of the modified form of the seat attachment.

DETAILED DESCRIPTION OF THE PREFERRED EMBODIMENTS

Figure 1:
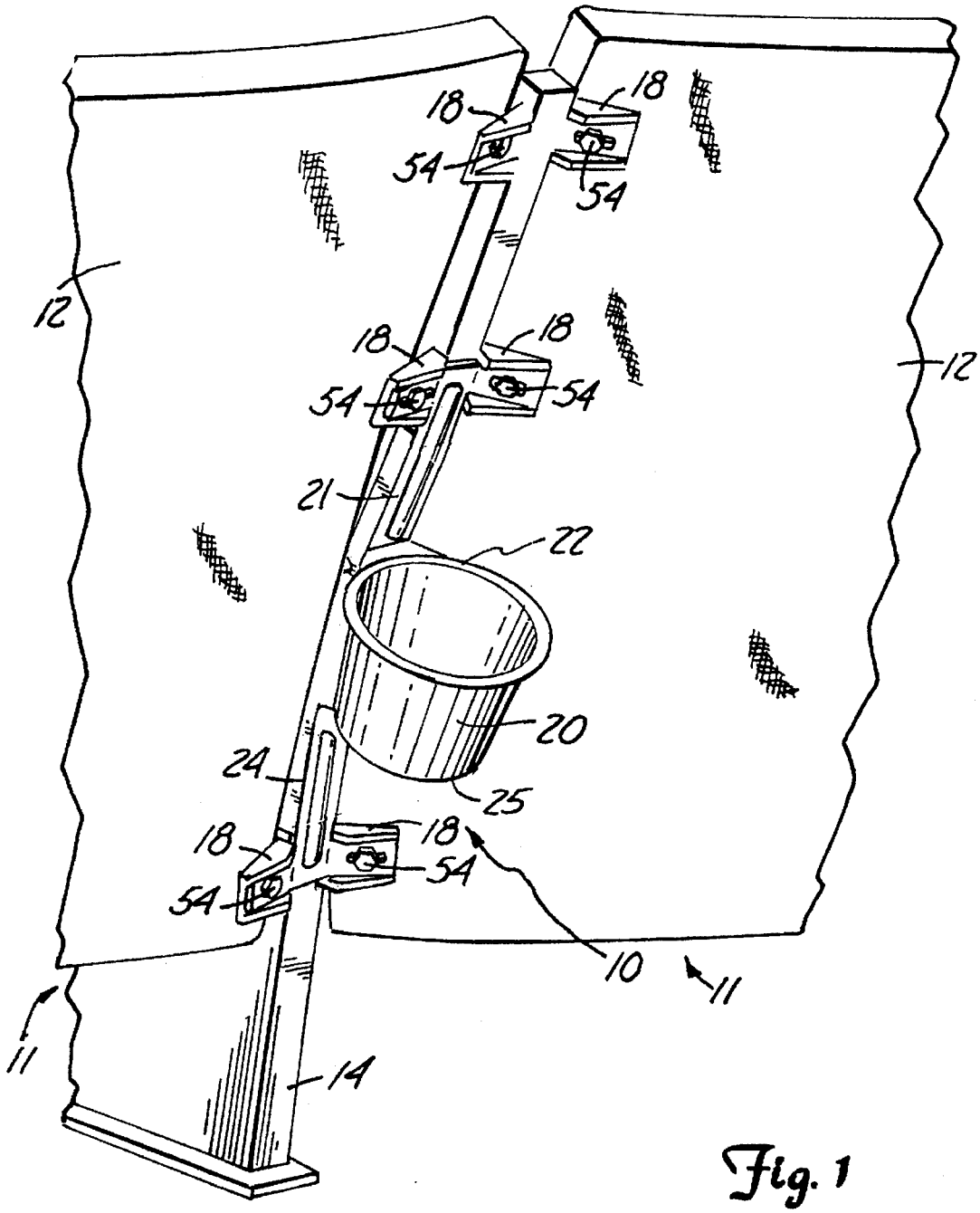
FIG. 1 is a perspective view of a portion of a seat having the seat attachment of the present invention mounted thereon.

A seat attachment 10 of the present invention is shown in FIG. 1 attached to two seats 11, each having a back 12 and attached to a standard 14. A plurality of seat brackets 18 which extend from the standard 14 are used to support the seat backs 12. The standard 14 and the seat brackets 18 are generally fabricated from a metal such as steel, aluminum or cast iron.

Figure 2:
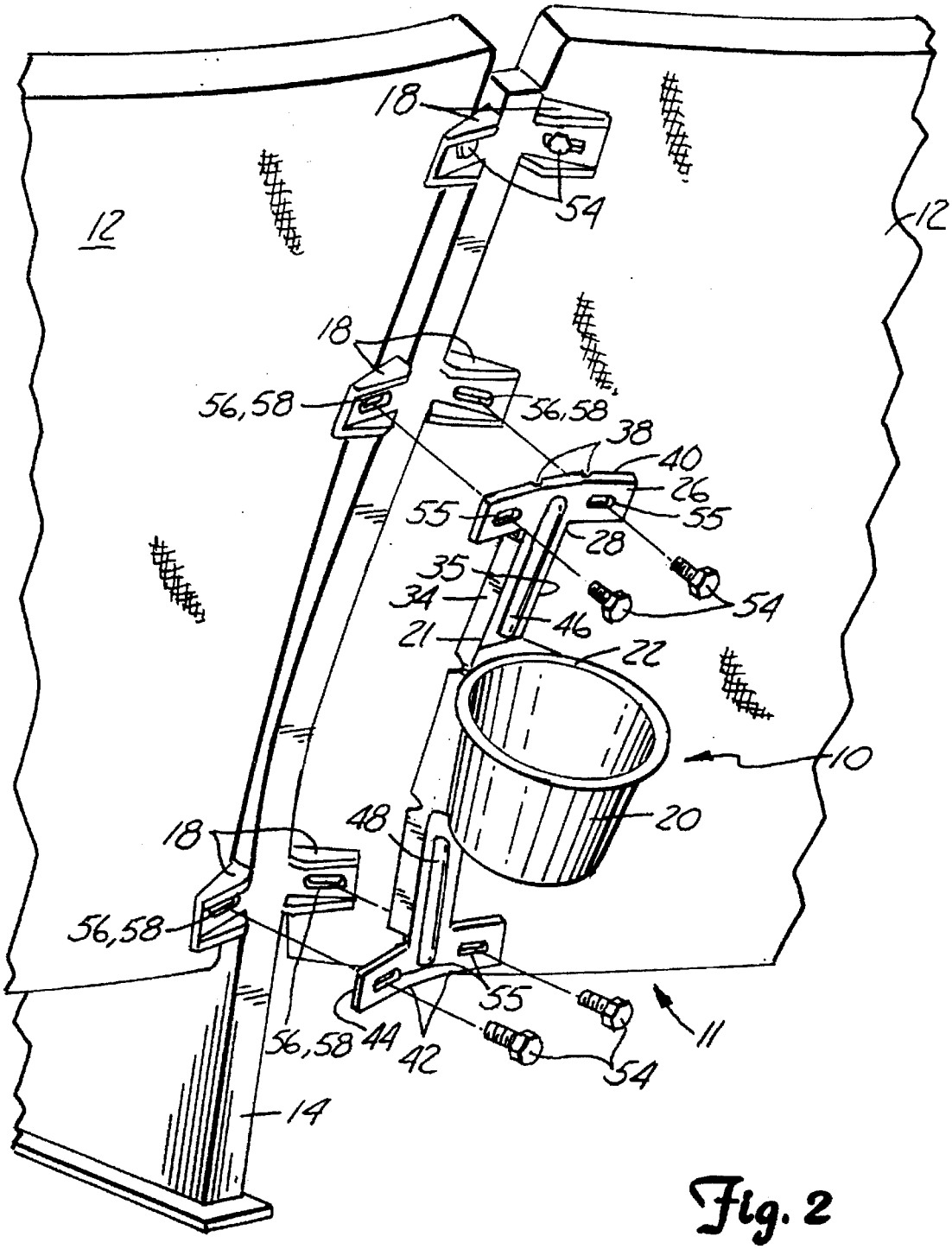
FIG. 2 is an exploded perspective view of a portion of the seat and the seat attachment of the present invention.

The seat attachment 10, which is shown in more detail in FIG. 2, is fabricated from a plastic such as polypropylene and comprises a generally cylindrical cupholder 20 having a first arm 21 extending from a generally open upper end 22 and a second arm 24 extending from a lower end 25. A first mounting bracket 26 is located at a first end 28 of the first arm 21 while a second mounting bracket 30 is located at a first end 32 of the second arm 24.

A first support wall 34 and a second support wall 35 protrude from both the first arm 21 and the second arm 24 and each extends along the first and second arms 21,24 between the first mounting bracket 26 and the second mounting bracket 30. When the seat attachment 10 is mounted on the standard 14, the first support wall 34 and the second support wall 35 come into contact with opposite sides of the standard 14 to prevent lateral motion of the seat attachment 10, holding it in place.

A first pair of parallel grooves 38 are located in a first side 40 of the first mounting bracket 26 while a second pair of parallel grooves 42 are located in a first side 44 of the second mounting bracket 30. The grooves 38,42 help enable the first and second mounting brackets 26,30 to conform to the shape of the seat brackets 18. A first stiffening rib 46 extends substantially the entire length of the first arm 21 while second stiffening rib 48 extends along substantially the entire length of the second arm 24. The stiffening ribs 46,48 help to strengthen the first and second arms 21,24 respectively.

Figure 3:
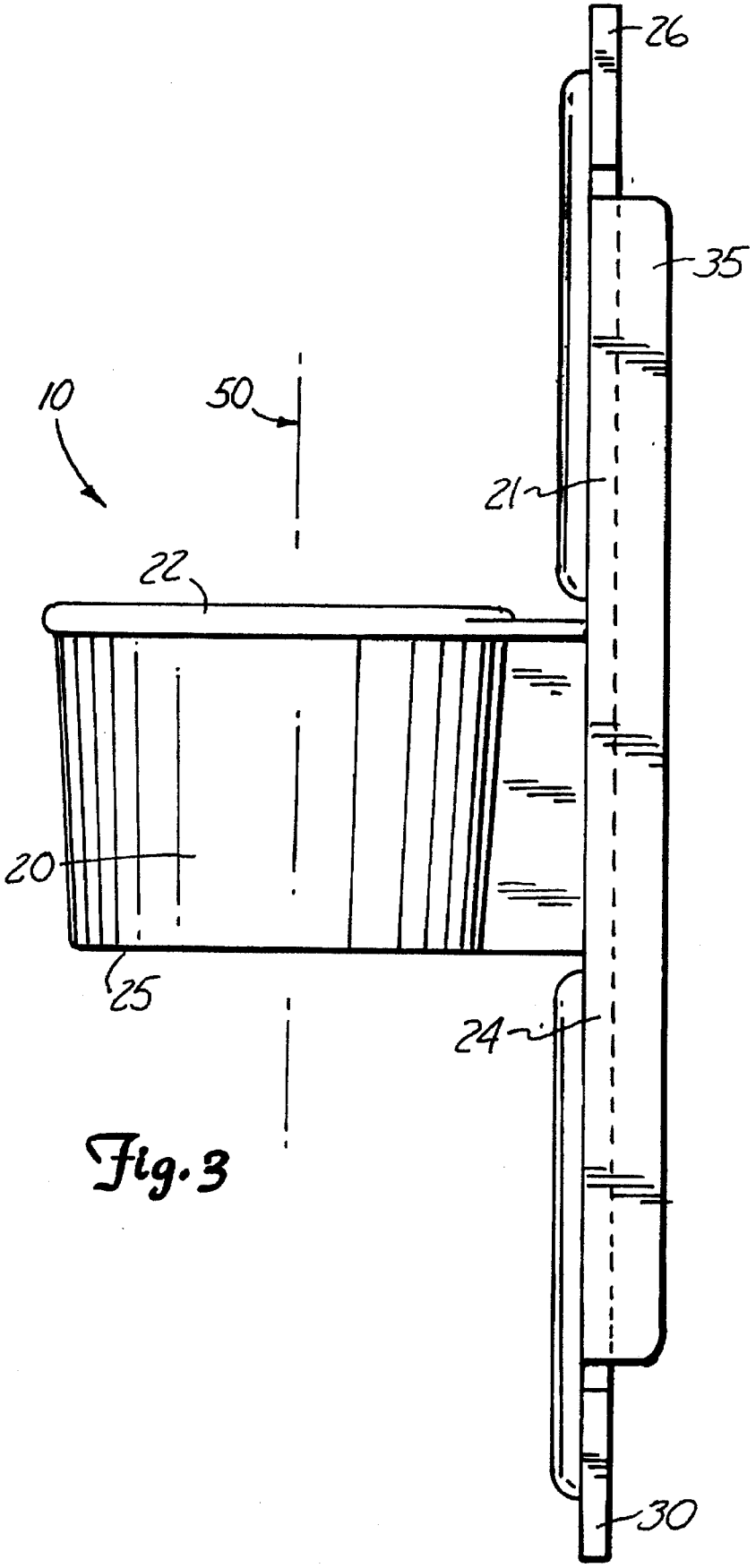
FIG. 3 is a side view of the seat attachment of the present invention.

The seat attachment 10 is shown in FIG. 3 as it appears before it is mounted on the standard 14. Both the first arm 21 and the second arm 24 extend in a direction generally parallel to a central axis 50 of the container holder 20. In addition, both the first mounting bracket 26 and the second mounting bracket 30 are flat and both are located in the same plane as the first arm 21 and the second arm 24.

Two bolts 54 are used to attach the first mounting bracket 26 to the standard 14 and the seats 11. Each bolt 54 extends through a mounting hole 55 in the first mounting bracket 26, through a corresponding hole 56 in one of the seat brackets 18, and is inserted into a pre-existing hole 58 in one of the seats 11. The second mounting bracket 30 is also attached to the standard 14 and to the seats 11 through the use of two bolts 54. Each bolt 54 extends through a mounting hole 55 in the second mounting bracket 30, through a corresponding hole 56 in one of the seat brackets 18 and is inserted into a pre-existing hole 58 in one of the seats 11.

As the bolts 54 are tightened, the first and second mounting brackets 26,30 and the first and second arms 21,24 will bend. The first mounting bracket 26 and the second mounting bracket 30 will bend to conform to the general shape of the seat brackets 18 to which they are attached. The first arm 21 and the second arm 24 will bend to generally conform to the shape of the standard 14 on which the seat attachment 10 is mounted. The container holder 20 is thus drawn closer to the standard 14, substantially preventing it from protruding into the aisle behind the backs 12 of the seats 11.

By attaching the seat attachment 10 directly to the seat brackets 18, no new holes need to be drilled in the seats 11. In addition, the bolts 54 used can be the same bolts that are used to attach the seat backs 12 to the standard 14. The bolts 54 are first removed from the seat brackets 18 and the seat backs 12, the seat attachment 10 is then put in place and the bolts 54 are inserted as previously described.

The spacing between the pairs of seat brackets 18 on the standard 14 varies between seat manufacturers. To accommodate the various spacings, both the first arm 21 and the second arm 24 can be made to have a variety of lengths without changing their overall design. The size and shape of the first and second mounting brackets 26,30 shown match the size and shape of the seat brackets 18 generally used by seat manufacturers. However, the first and second mounting brackets 26,30 can be fabricated in a variety of sizes and shapes to correspond with a variety of seat brackets 18.

In a first alternative embodiment of the present invention, shown in FIGS. 4 and 5, a seat attachment 63 comprises a generally cylindrical container holder 64, a first arm 66 extending from an upper end 67 of the container holder 64 and an adjustable second arm 68 extending from a lower end 69 of the container holder 64. A sleeve 70 is attached to a first side 72 of the container holder 64 and the second arm 68 is inserted into the sleeve 70. The second arm 68 can slide within the sleeve 70 to vary the distance that the second arm 68 extends from the container holder 64. By adjusting the length the second arm 68 in this manner, the seat attachment 63 can be adapted to be mounted on standards having seat brackets with a variety of spacings.

The second arm 68 is held fixed with respect to the sleeve 70 by a tightening nut 74 which extends through a first hole 76 in the sleeve 70, through an elongated slot 78 in the second arm 68 and into a second hole 80 in the sleeve 70. When the tightening nut 74 is loosened, the second arm 68 is free to slide in the sleeve 70. When the tightening nut 74 is removed, the second arm 68 can be completely removed from the sleeve 70, The remainder of the seat attachment 63 is substantially the same as that of the seat attachment 10 described in the first embodiment.

Although the present invention has been described with reference to preferred embodiments, workers skilled in the art will recognize that changes may be made in form and detail without departing from the spirit and scope of the invention.

What is claimed is:

1. A method for mounting an open top container holder to a seat having a standard which does not require the use of any bolts other than the bolts used to attach the seat to the standard, the method comprising the steps of:

providing a container holder having at least one mounting member extending upward along a generally upright container holder axis from an open top end of the container holder component which is perpendicular to a plane of the and having a plurality of mounting holes through the mounting member positioned laterally of an upright center plane of the container holder;

removing the bolts used to attach the seat to the standard from a plurality of holes in the standard and a plurality of corresponding holes in the seat;

positioning the container holder so that each of a plurality of mounting holes located in the mounting member aligns with one of the holes in the standard and a corresponding one of the holes in the seat; and inserting the previously removed bolts used to attack the seat to the standard through the mounting holes located in the mounting member, the holes in the standard and the holes in the seat.

2. The method of claim 1 and the further step of tightening the bolts so that the mounting member substantially conforms to the contour of the seat on which the container holder is mounted.

3. The method of claim 2 wherein the bolts used to attach the seat to the standard comprise at least a pair of bolts laterally spaced on opposite sides of a bisecting plane which bisects the mounting member in a longitudinal direction of the mounting member, wherein the longitudinal direction of the mounting member extends upward along a generally upright container holder axis.

4. The method of claim 1 wherein the holes in the mounting member comprises laterally elongated slots.

* * * * *

UNITED STATES PATENT AND TRADEMARK OFFICE

CERTIFICATE OF CORRECTION

PATENT NO. : 5,628,103

DATED : May 13, 1997

INVENTOR(S) : Ayotte et al.

It is certified that error appears in the above-indentified patent and that said Letters Patent is hereby corrected as shown below:

Column 4, lines 23-24, cancel "component which is perpendicular to a plane of the".

Column 4, line 34, cancel "attack" and insert "--attach--".

Signed and Sealed this

Sixteenth Day of September, 1997

Bruce Lehman

*Attest:*

BRUCE LEHMAN

*Attesting Officer*

*Commissioner of Patents and Trademarks*